United States Patent [19]

Suhr et al.

[11] 3,984,175

[45] Oct. 5, 1976

[54] PAVEMENT MARKER

[75] Inventors: Donald C. Suhr, Farmington Hills, Mich.; Robin A. Arnott, Windsor, Canada; John F. Domaracki, Windsor, Canada; Peter Hedgewick, Windsor, Canada

[73] Assignee: International Tools (1973) Ltd., Windsor, Canada

[22] Filed: Mar. 13, 1975

[21] Appl. No.: 558,036

[52] U.S. Cl. ..... 350/103; 350/109; 350/106

[51] Int. Cl.[2] ..... G02B 5/124

[58] Field of Search ..... 350/97, 103, 109, 106; 404/12, 10, 14

[56] References Cited

UNITED STATES PATENTS

| | | | |
|---|---|---|---|
| 2,635,513 | 4/1953 | Batterson | 350/104 |
| 3,485,148 | 12/1969 | Heenan | 404/12 |
| 3,587,416 | 6/1971 | Flanagan | 350/103 |
| 3,758,191 | 9/1973 | Hedgewick | 350/103 |

FOREIGN PATENTS OR APPLICATIONS

| | | | |
|---|---|---|---|
| 1,103,505 | 2/1968 | United Kingdom | 350/94 |

*Primary Examiner*—John K. Corbin
*Assistant Examiner*—B. Wm. delos Rayes
*Attorney, Agent, or Firm*—Reising, Ethington, Barnard, Perry & Brooks

[57] ABSTRACT

A pavement marker of the type including a shell-like body of light transmitting material, such as synthetic resin, having a reflective wall formed thereon, and which is filled with epoxy resin or the like for reinforcing the shell-like body against external forces applied by vehicles. The body has a fore and aft axis that intersects the reflective wall and extends parallel to the direction of travel of vehicles when the base of the pavement marker is secured to a roadway. The reflective wall has a lower edge adjacent the plane of the base that is spaced forwardly of the upper edge thereof such that the reflective wall is in nonperpendicular relationship with the plane of the base, and the outer surface of the reflective wall is curved outwardly and downwardly between the upper and lower edges. The reflective wall also curves rearwardly from the fore and aft axis on opposite sides thereof. The body also has a top surface that is convexly curved. The convex curvature of the reflective wall and top wall in opposition to external forces provides additional strength to the shell-like body.

9 Claims, 5 Drawing Figures

PAVEMENT MARKER

BACKGROUND OF THE INVENTION

1. FIELD OF THE INVENTION

This invention relates generally to pavement markers, and is particularly concerned with pavement markers of the type having a shell-like body of light transmitting material with a reflective wall formed with retrodirective reflector elements, and which is reinforced with a filler material, such as epoxy resin.

2. DESCRIPTION OF THE PRIOR ART

It has become common practice to delineate traffic lanes and the edgs of roadways by pavement markers having retrodirective reflector elements, such as cube corner reflex reflector elements, for reflecting the lights from vehicles travelling over the roadways at night. Such pavement markers are superior to painted strips on the roadway since, uner poor weather conditions, painted strips on the roadway are not visible.

U.S. Pat. Nos. 3,332,327 and 3,409,344 disclose pavement markers having planar reflective walls formed on their inner surfaces with cube corner reflector elements. The reflective walls form part of a shell-like body of synthetic resin or the like, which, when installed on the surface of a roadway, is filled with a filler material such as epoxy resin to reinforce the shell-like body against external forces imposed particularly by vehicles travelling over the roadway. The impact forces of vehicles are sometimes great enough to rupture the shell-like body of such pavement markers, particularly when a void occurs in the filler material. The flat, planar walls of the shell-like body rupture more easily when a void occurs in the filler adjacent to the wall of the shell-like body. Voids are particularly difficult to detect when the void occurs adjacent to the reflective wall, which is the wall that usually receives the greates impact. The cube corner reflector elements formed on the inner surface of the reflective wall renders it impossible to visually detect a void behind the reflector elements.

SUMMARY OF THE INVENTION

An object of the present invention is to provide an improved pavement marker of the type having a shell-like body formed with a reflective wall and provided with a filler as reinforcement against external forces wherein the shell-like body has no flat surfaces subjected to impact forces, all of the external surfaces being convexly curved in opposition to external forces such as are imposed by vehicle wheels travelling over the roadway.

A further object is to provide an improved pavement marker of the type having a shell-like body with a reflective wall formed with retrodirective reflector elements, such as cube corner reflex reflector elements, the shell-like body being reinforced with a filler material, wherein the reflective wall is convexly curved to provide higher strength in the shell-like body to resist external forces, even upon the occurrence of voids in the filler material.

In carrying out the foregoing, and other objects, a pavement marker according to the present invention includes a shell-like body of light transmitting material having a base adapted to be secured to the surface of a roadway and a reflective wall for reflecting light from vehicles on the roadway, the body having a fore and aft axis that intersects the reflective wall and extends parallel to the direction of travel of vehicles when the base is secured to a roadway. The reflective wall has a lower edge adjacent the plane of the base, an upper edge spaced from the plane of the base, a pair of side edges located on opposite sides of the fore and aft axis and extending between the upper and lower edges, and inner and outer surfaces extending between the upper, lower and side edges. The lower edge is spaced forwardly of the upper edge such that the reflective wall is in nonperpendicular relationship with the plane of the base, the outer surface of the relfective wall being curved outwardly and downwardly between the upper and lower edges. The outer surface of the reflective wall also curves rearwardly from the fore and aft axis on opposite sides thereof to the side edges.

A plurality of retrodirective reflector elements, preferably of the cube corner type, are formed on the inner surface of the reflective wall, each of the reflector elements projecting rearwardly and having an apex located remotely from the outer surface and an axis passing therethrough. The reflector elements are oriented such that each axis thereof extends at an acute angle with respect to the plane of the base to align the apices of the reflector elements relative to the light refracted, as a result of the nonperpendicular relationship of the reflective wall with the plane of the base, for receiving such refracted light and reflecting the refracted light to return the incident light generally parallel to the direction of incidence after refraction of the reflected light at the outer surface of the reflective wall. The shell-like body is filled with a filler material, such as epoxy resin, for reinforcing the shell-like body against external forces.

The inner surface of the retrodirective reflector elements are preferably metallized to provide resistance to moisture and chemical attack.

Further resistance to rupture or fracture of the shell-like body is provided by crowning the top surface of the shell-like body so that it is convexly curved upwardly in opposition to external forces.

Other objects, advantages and features of the invention will become apparent from the following description taken in connection with the accompanying drawings.

DESCRIPTION OF THE PREFERRED EMBODIMENT

Figure 1:
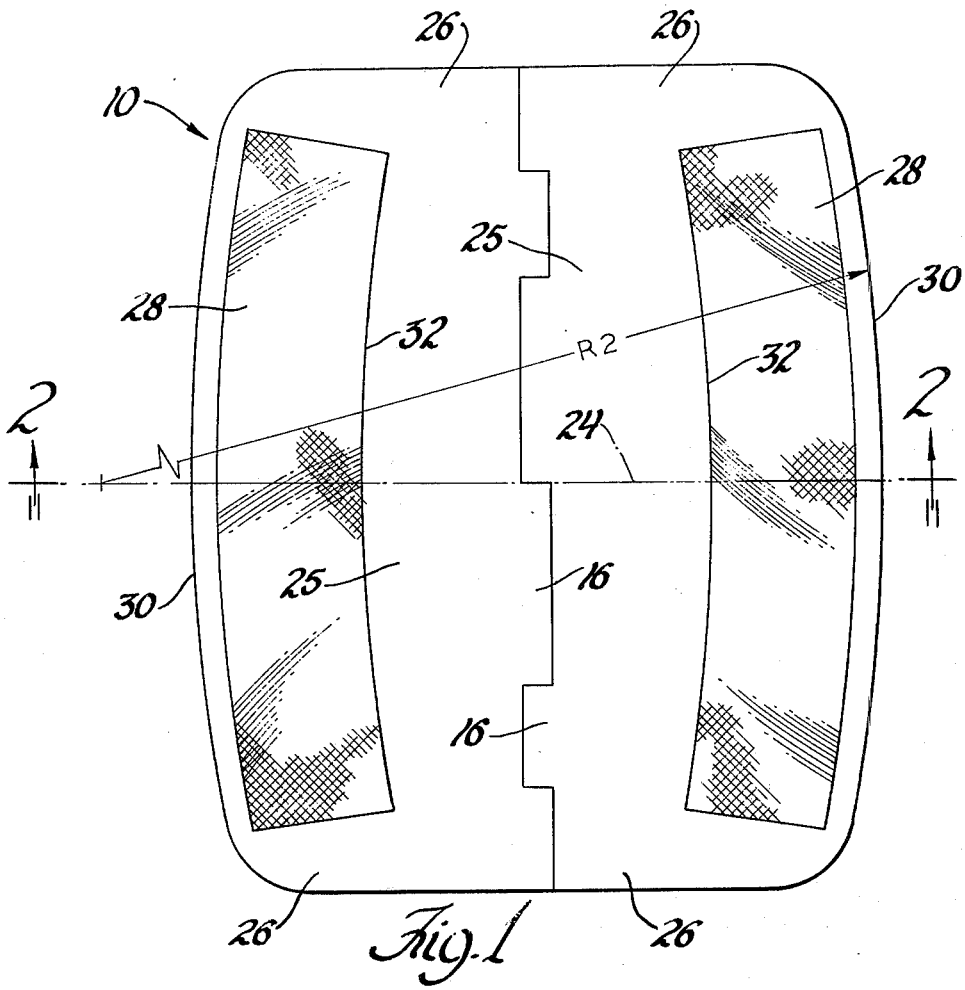
FIG. 1 is a top plan view of a pavement marker according to the present invention.

In the drawings, reference numeral 10 collectively designates a shell-like body of light transmitting material, the body 10 being made up of a pair of complementary shell members 12. The shell members 12 are formed on their mating peripheral edges with complementary interfitting tabs 14 and 16. Tabs 14 are formed by recesses in the outer surface of the shell member, while tabs 16 are formed by recesses in the inner surface of the shell member. The shell-like body 10 is reinforced with a filler 20 (FIG. 2) of epoxy resin or the like. The inner surfaces of the top portion of each of the shell members 12 is formed with a plurality of depending projections 22 to assist in securing a bond between the filler 20 and the inner surface of the shell members 12 and 14.

Reference numeral 24 (FIG. 1) indicates the fore and aft axis of the body 10, which fore and aft axis is adapted to extend parallel to the direction of travel of vehicles when the body 10 is secured to the surface of a roadway.

Each shell member 12 includes a top wall 25, side walls 26 and a reflective wall 28. The reflective wall 28 has a lower edge 30 adjacent the plane of the base 17, an upper edge 32 spaced from the plane of the base, a pair of side edges 34 located on opposite sides of the fore and aft axis and extending between the upper and lower edges, and inner and outer surfaces 36 and 38, respectively, extending between said upper, lower and side edges 32, 30 and 34, respectively.

Figure 2:
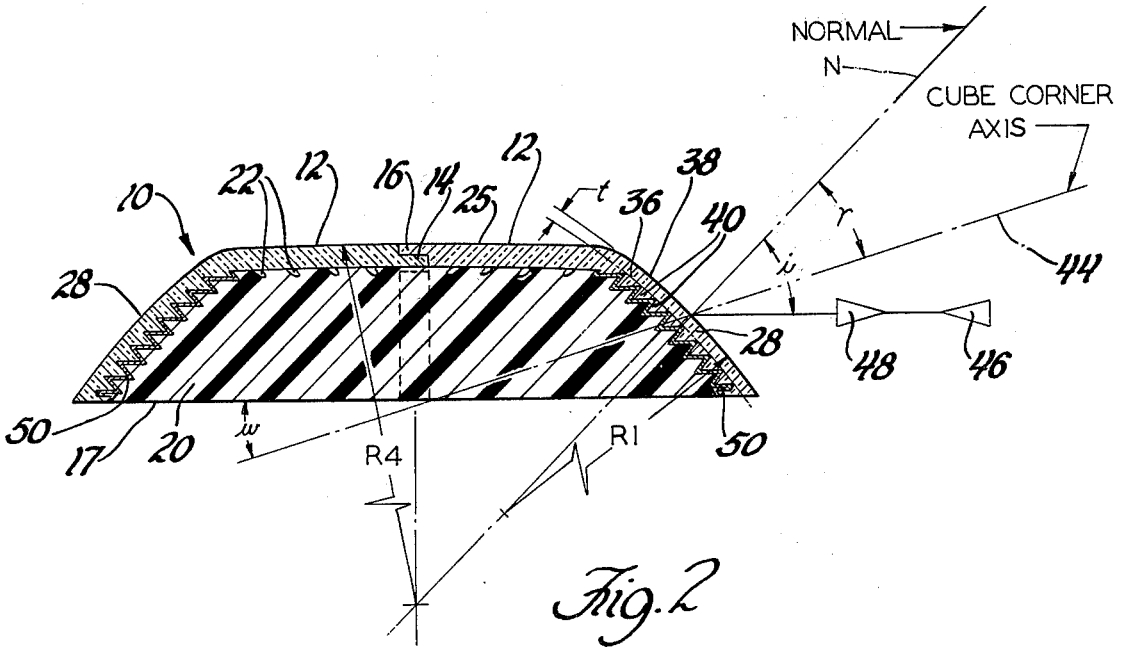
FIG. 2 is a sectional view taken on lines 2—2 of FIG. 1.
Figure 3:
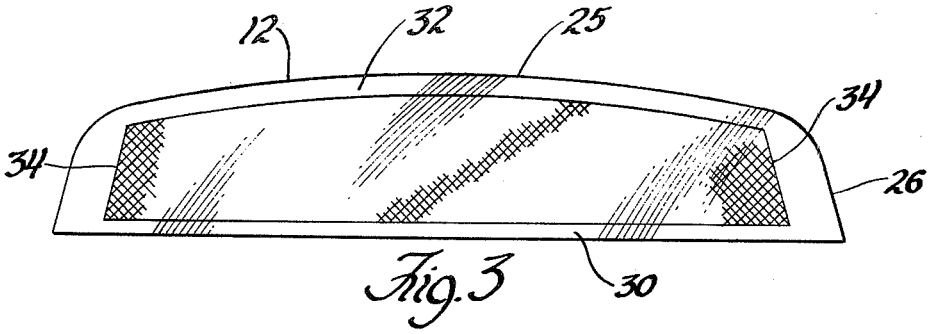
FIG. 3 is an elevational view taken on lines 3—3 of FIG. 1.

As shown particularly in FIG. 2, the lower edge 30 of the reflective wall 28 is spaced forwardly of the upper edge 32 such that the reflective wall is in nonperpendicular relationship with the plane of the base 17, the outer surface 38 being curved outwardly and downwardly between the upper and lower edges 32 and 30, respectively. As shown in FIG. 1, the reflective wall 28 curves rearwardly from the fore and aft axis on opposite sides thereof to the side edges 34. The outer surface 38 curves outwardly and downwardly from the upper edge 32 to the lower edge 30 in a vertical plane with a radius of curvature R1 (FIG. 2) which, by way of example, may be three inches. The reflective wall 28 curves rearwardly on opposite sides of the fore and aft axis 24 with a radius indicated at R2 in FIG. 1, which, by way of example, may be 10 inches.

The top wall 25 is convexly curved between the side edges 26 with a radius of curvature R3 (FIG. 4), which radius of curvature, by way of example, may be 10 inches. The top wall 25 is further curved convexly from the reflective wall 28 with a radius of curvature indicated at R4 in FIG. 2, which radius, by way of example, may be 50 inches.

The reflective wall 28 is formed on the inner surface 36 thereof with a plurality of retrodirective reflector elements 40, each of the retrodirective reflector elements 40 preferably being of the cube corner type having an apex 42 located remotely from the outer surface 38 and projecting rearwardly or inwardly from the inner surface 36. Each of the reflector elements 40 has an axis 44 passing through the apex 42.

Figure 4:
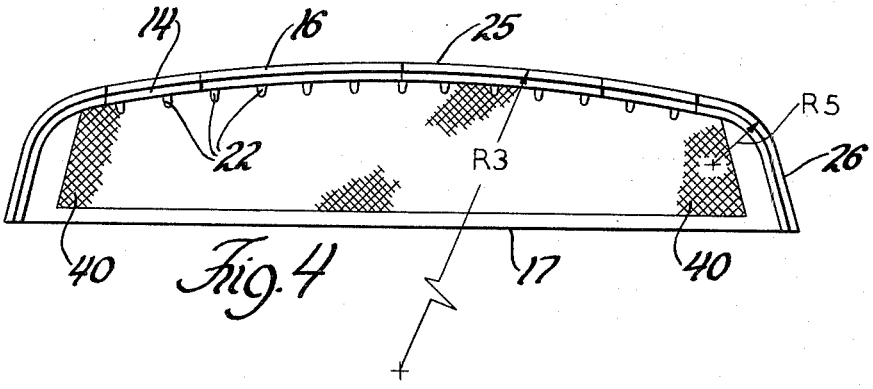
FIG. 4 is an end view of one of the shell members forming a portion of the shell-like body of the pavement marker as lines along line 4—4 of FIG. 5.

The junction between the side walls 26 and top wall 25 is curved, the radius of curvature being indicated at R5 in FIG. 4. By way of example, R5 may be 0.75 inches. In the illustrated embodiment, the side walls 26 blend into substantially straight portions below the curved junction having radius R5, which straight sections are inclined with respect to the vertical at an angle on the order of 15°.

Figure 5:
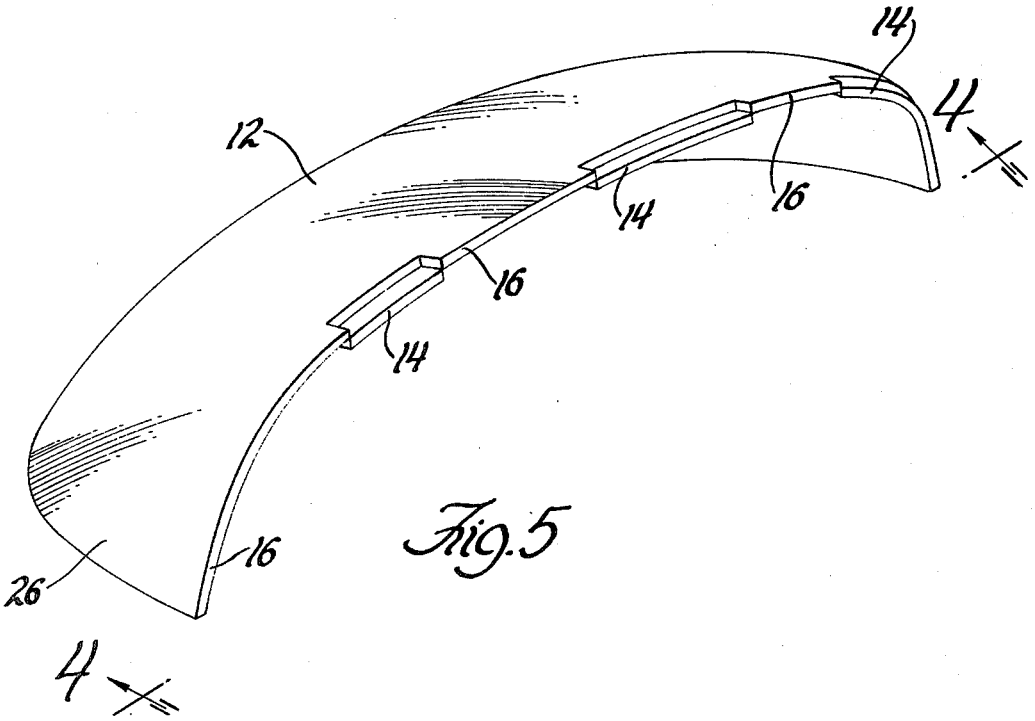
FIG. 5 is a perspective view of the shell member of FIG. 4.

An incident light ray from the headlights of a vehicle on the roadway is indicated by arrow 46 in FIG. 5, the light ray indicated by arrow 46 being illustrated as being parallel to the plane of the base 17, and hence the surface of the roadway. The angle of the light rays from the vehicle headlights will vary a few degrees on either side of the horizontal depending on the positiion of the vehicle with respect to the pavement marker. The reflective wall 28 has a normal N passing through the outer surface 38 midway between the upper and lower edges 30 and 32 as shown in FIG. 2. In FIG. 2, the material of the shell members 12, and hence of the reflective wall 28, has an angle of refraction *r*, and the axis 44 of the cube corner reflector elements 40 located midway between the upper and lower edges of the reflective wall 28 extends at an acute angle *w* with respect to the plane of the base 17, and at an acute angle *r* with respect to normal N. Consequently, incident light in the direction of arrow 46 will strike the outer surface 38 of the reflective wall 28 at an angle of incidence *i* with respect to the normal N, and will be refracted along the axis 44 in FIG. 2 so that when reflected, the reflected light will return in the direction of arrow 48 parallel to the direction of incidence. Thus, the reflector elements 40 are oriented such that each axis thereof extends at an acute angle *w* with respect to the plane of the base to align the apices 42 relative to the angle of refraction, as a result of the non-perpendicular relationship of the reflective wall 20, for receiving the refracted light and reflecting the refracted light so as to return the incident light generally parallel to the direction of incidence.

In the illustrated embodiment, both reflective walls 28 are identical in construction, and only one will therefore be described in detail. The thickness of the reflective wall 28 between the inner and outer surfaces 36 and 38 is indicated at *t* in FIG. 2, and will vary depending upon the material of the reflector body. The angle of refraction *r* will also vary, depending upon the material used. As a specific example, the material may be acrylic having a thickness *t* of 0.060 inches, with the angle of refraction *r* of 28.33°, and the angle of incidence *i* of 45°. The foregoing specific values are by way of example only, and are not to be considered a limitation.

The inner surfaces of the cube corner reflector elements 40 are provided with a metallized layer 50 to protect the reflector elements 40 from moisture and chemical attack. If the pavement marker is required to reflect in only one direction, the metallized layer 50 can be omitted from one of the reflective walls 28 as an alternative to providing a wall having no reflector elements formed thereon.

The employment of two shell members 12 with interfitting tabs 14 and 16 facilitates the fabrication of the marker 10 in different colors to provide different signals in opposite directions.

While the illustrated embodiment employs cube corner reflector elements, it is within the scope of the invention to employ retrodirective reflector elements other than of the cube corner type. For example, the retrodirective reflector elements may be of conical configuration. Alternatively, the retrodirective reflector elements at the central portion of the reflective wall can be conical, with cube corner reflector elements provided on opposite sides of the central, conical reflector elements.

The axes of the reflector elements in the illustrated embodiment are parallel to each other and to the fore and aft axis 24 as viewed in a horizontal plane (or in plan) to facilitate manufacture. However, it is of course possible, and within the scope of the invention, for the axes of some of the reflector elements to be in nonparallel relationship with the axes of the other reflector elements. For example, the axes of the reflector elements adjacent the side edges of the reflector walls 28 may make an acute angle with the fore and aft axis 24 and with the axes of the reflector elements at the central portion of the reflective wall.

While a specific form of the invention has been illustrated and described in the accompanying drawings and foregoing specification, it should be understood that the invention is not limited to the exact construction shown. To the contrary, alterations in the construction and arrangement of parts, all falling within the scope and spirit of the invention, will be apparent to those skilled in the art.

The embodiments of the present invention in which an exclusive property or privilege is claimed are defined as follows:

1. A pavement marker comprising: a shell-like body of light transmitting material having a base adapted to be secured to the surface of a roadway and a reflective wall for reflecting light from vehicles on the roadway, the body having a fore and aft axis that intersects said reflective wall and extends parallel to the direction of travel of vehicles when the base is secured to a roadway; said reflective wall having a lower edge adjacent the plane of said base, an upper edge spaced from the plane of said base, a pair of side edges located on opposite sides of said fore and aft axis and extending between said upper and lower edges, and inner and outer surfaces extending between said upper, lower and side edges; said lower edge being spaced forwardly of said upper edge such that said reflective wall is in nonperpendicular relationship with the plane of said base, said outer surface being curved outwardly and downwardly between said upper and lowed edges on a first radius of curvature; said reflective wall curving rearwardly from said fore and aft axis on opposite sides thereof to said side edges on a second radius of curvature greater than said first radius of curvature; a plurality of retrodirective reflector elements formed on said inner surface; each of said reflector elements projecting rearwardly and having an apex located remotely from said outer surface and an axis passing therethrough; said reflector elements being oriented such that each axis thereof extends at an acute angle with respect to the plane of said base to align the apices of said reflector elements relative to the light refracted, as a result of the nonperpendicular relationship of said reflective wall with the plane of said base, for receiving such refracted light and reflecting the refracted light to return the incident light generally parallel to the direction of incidence after refraction of the reflected light at said outer surface; and a hard filler material of epoxy resin or the like contiguous with the inner surface of said shell-like body for reinforcing said shell-like body against external forces on said body.

2. A pavement marker as claimed in claim 1 wherein the axes of said reflector elements are parallel to each other.

3. A pavement marker as claimed in claim 2 wherein the axes of said reflector elements are each parallel to said fore and aft axis and a plane parallel to the plane of said base.

4. A pavement marker as claimed in claim 3 wherein said reflector elements are cube corner reflector elements.

5. A pavement marker comprising: a shell-like body of light transmitting material having a base adapted to be secured to the surface of a roadway; said body having a top wall, a pair of side walls depending from the top wall, and a reflective wall depending from the top wall and extending between the side walls; said body having a fore and aft axis that intersects said reflective wall and extends parallel to the direction of travel of vehicles when the base is secured to a roadway; said reflective wall having a lower edge adjacent the plane of said base, an upper edge spaced from the plane of said base, a pair of side edges located on opposite sides of said fore and aft axis and extending between said upper, lower and side edges; said lower edge being spaced forwardly of said upper edge such that reflective wall is in nonperpendicular relationship with the plane of said base, said outer surface being curved outwardly and downwardly between said upper and lower edges on a first radius of curvature; said reflective wall curving rearwardly from said fore and aft axis on opposite sides thereof to said side edges on a second radius of curvature greater than said first radius of curvature; a plurality of retrodirective reflector elements of the cube corner type formed on said inner surface; each of said reflector elements projecting rearwardly and having an apex located remotely from said outer surface and an axis passing therethrough; said reflector elements being oriented such that each axis thereof extends at an acute angle with respect to the plane of said base to align the apices of said reflector elements relative to the light refracted, as a result of the nonperpendicular relationship of said reflective wall with the plane of said base, for receiving such refracted light and reflecting the refracted light to return the incident light generally parallel to the direction of incidence after refraction of the reflected light at said outer surface; the axes of said reflector elements being parallel to each other and to said fore and aft axis in a plane parallel to the plane of said base; said top wall of said body being convexly curved with a third radius of curvature greater than said first radius of curvature and a hard filler material of epoxy resin or the like contiguous with the inner surface of said shell-like body for reinforcing said shell-like body against external forces on said body.

6. A pavement marker comprising: a shell-like body of light transmitting material having a base adapted to be secured to the surface of a roadway; said shell-like body having a top wall, a pair of spaced side walls depending from said top wall, and a pair of oppositely directed reflective walls depending from said top wall and extending between said side walls; said body having a fore and aft axis that intersects said reflective walls and extends parallel to the direction of travel of vehicles when the base is secured to a roadway; said top wall having a convex radius of curvature between said side walls, and a convex radius of curvature between said reflective walls that is different from its radius of curvature between said side walls; the junction between said side walls and said top wall being curved; each of said reflective walls having a lower edge adjacent the plane of said base, an upper edge spaced from the plane of said base, a pair of side edges located on opposite sides of said fore and aft axis and extending between said upper and lower edges, and inner and outer surfaces extending between said upper, lower and side edges; said lower edge of each reflective wall being spaced forwardly of the upper edge thereof such that said reflective wall is in nonperpendicular relationship with the plane of said base, the outer surface of said reflective wall being curved outwardly and downwardly between said upper and lower edges on a first radius of curvature; each of said reflective walls curving rearwardly toward the other reflective wall from said fore and aft axis on opposite sides thereof to said side edges on a second radius of curvature greater than said first radius of curvature; a plurality of retrodirective reflector elements formed on the inner surface of each of said reflective walls; each of said reflector elements projecting rearwardly toward the opposite reflective wall and having an apex located remotely from said outer surface and an axis passing therethrough; said reflector elements being oriented such that each axis thereof extends at an acute angle with respect to the plane of said base to align the apices of said reflector elements relative to the light refracted, as a result of the nonperpendicular relationship of the respective reflective wall with the plane of said base, for receiving such refracted light and reflecting the refracted light to return the incident light generally parallel to the direction of incidence after refraction of the reflected light at said outer surface; and a hard filler material of epoxy resin or the like contiguous with the inner surface of said shell-like body for reinforcing said shell-like body against external forces on said body.

7. A pavement marker as claimed in claim 6 wherein said shell-like body is made up of a pair of complementary shell members, each of said shell members having a peripheral edge portion at said side walls and top wall with tabs projecting therefrom formed by alternating recesses in the inner and outer surfaces of said side and top walls, the tabs of one of said shell members interfitting with the tabs of the other said shell members, such that the top and side walls of the shell members are continuous.

8. A pavement marker as claimed in claim 7 further including a plurality of projections depending from the inner surface of the top wall to form a mechanical interlock between the filler material and the shell members.

9. A pavement marker shell comprising: a shell-like body of light transmitting material having a base adapted to be secured to the surface of a roadway and a reflective wall for reflecting light from vehicles on the roadway, the body having a fore and aft axis that intersects said reflective wall and extends parallel to the direction of travel of vehicles when the base is secured to a roadway; said reflective wall having a lower edge adjacent the plane of said base, an upper edge spaced from the plane of said base, a pair of side edges located on opposite sides of said fore and aft axis and extending between said upper and lower edges, and inner and outer surfaces extending between said upper, lower and side edges; said lower edge being spaced forwardly of said upper edge such that said reflective wall is in nonperpendicular relationship with the plane of said base, said outer surface being curved outwardly and downwardly between said upper and lower edges on a first radius of curvature; said reflective wall curving rearwardly from said fore and aft axis on opposite sides thereof to said side edges on a second radius of curvature greater than said first radius of curvature; and a plurality of retrodirective reflector elements formed on said inner surface.

* * * * *